US005869780A

United States Patent [19]

Lim

[11] Patent Number: 5,869,780

[45] Date of Patent: Feb. 9, 1999

[54] TUNING PIN APPARATUS HAVING IMPEDIMENT FUNCTION AGAINST THE REWINDING

[76] Inventor: Won Ki Lim, 289-2 Hwuikyung-dong, Dongdaemoon-ku, Seoul, Rep. of Korea

[21] Appl. No.: 892,918

[22] Filed: Jul. 15, 1997

[51] Int. Cl.[6] ..... G10C 3/10

[52] U.S. Cl. ..... 84/201; 84/202; 84/304; 84/305

[58] Field of Search ..... 84/201, 202, 304, 84/305

[56] References Cited

U.S. PATENT DOCUMENTS

| | | | |
|---|---|---|---|
| 31,589 | 3/1861 | Clark | 84/201 |
| 1,351,616 | 8/1920 | Burke | 84/201 |
| 2,736,224 | 2/1956 | Trinkle | 84/201 |
| 3,754,494 | 8/1973 | Ticehurst . | |
| 4,398,443 | 8/1983 | Kovach . | |
| 4,920,847 | 5/1990 | Conklin, Jr. . | |
| 5,471,902 | 12/1995 | Chaplin . | |

*Primary Examiner*—William M. Shoop, Jr.
*Assistant Examiner*—Kim Lockett
*Attorney, Agent, or Firm*—Irving M. Fishman; Michael J. Brown

[57] ABSTRACT

A piano tuning pin apparatus for prevention of loosening of the piano string, i.e., of rewinding of a piano tuning pin, characterized by setting the tuning pin constructed additionally a brake structure having the impediment function against the rewinding on the circumference surface of the piano tuning pin and the fixing portion of pin having two putting pipes each other, to prevent loosening of the piano. Between a tuning hammer tip inserting part and a hole of the tuning pin, a brake structure is formed to take a projection having a suitable distance and height along with a circumference surface.

7 Claims, 4 Drawing Sheets

【Fig.1】
Prior Art
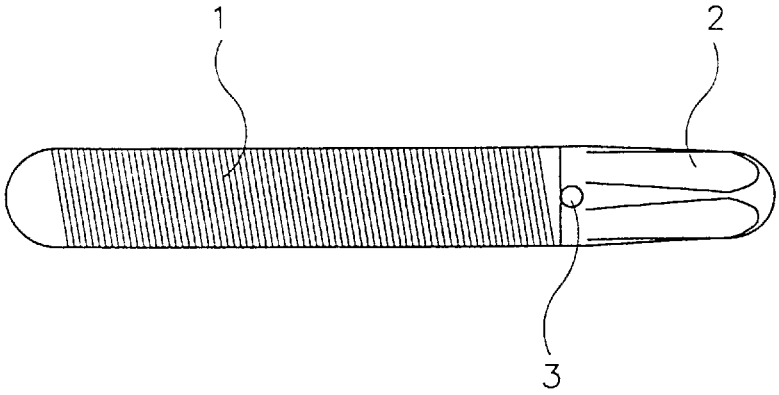
【Fig.2】
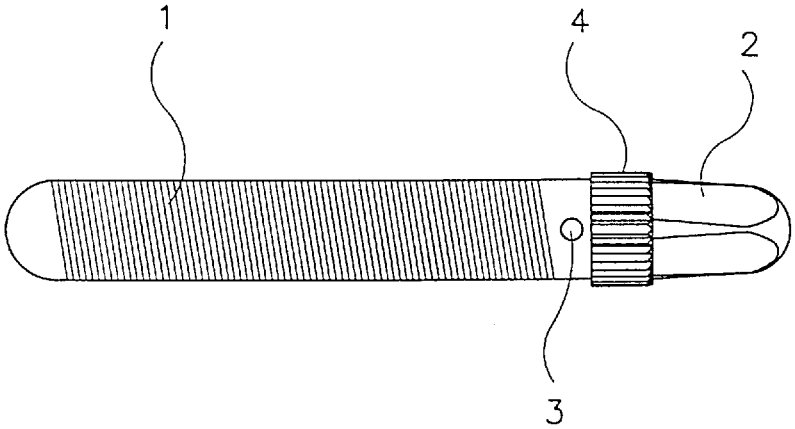

【Fig.3】
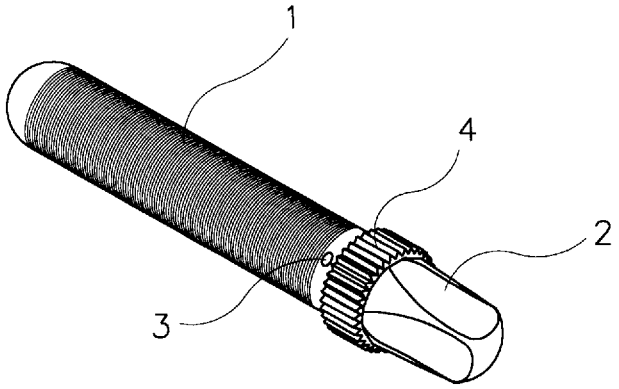
【Fig.4】
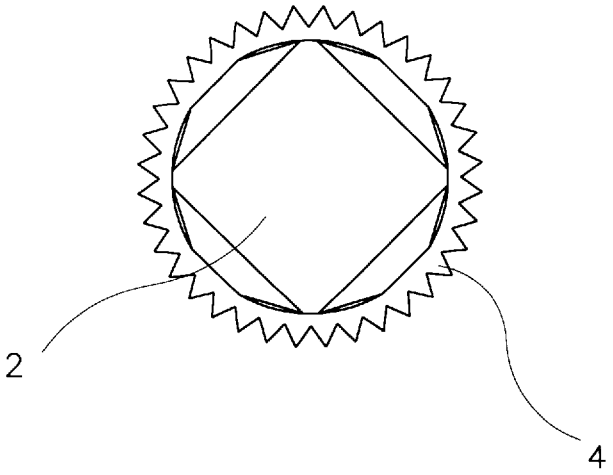

【Fig.5】
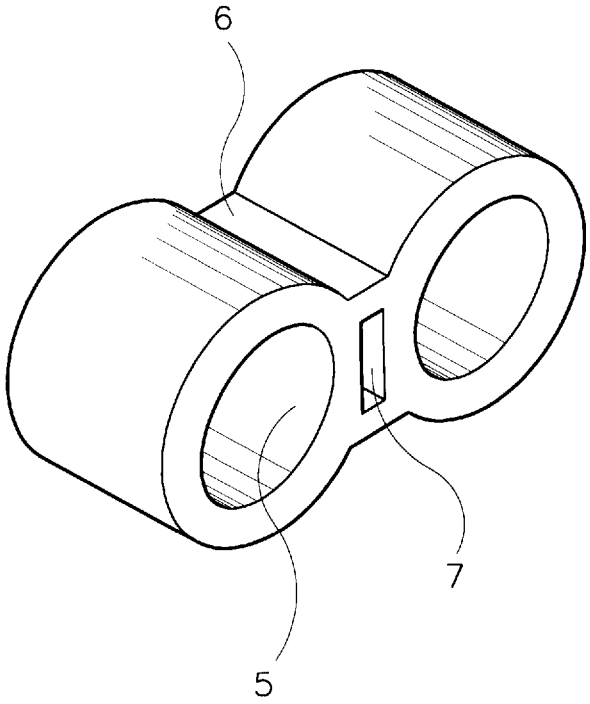
【Fig.6】
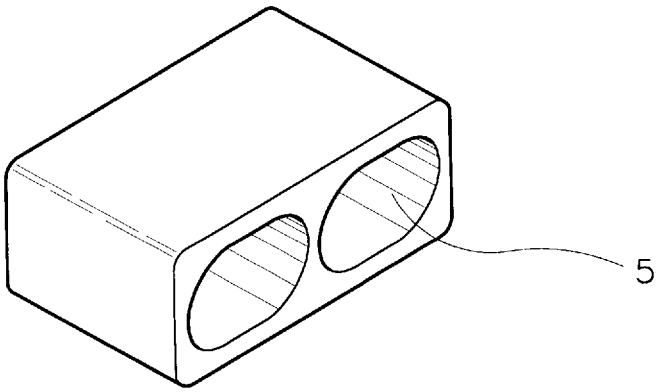

【Fig.7】
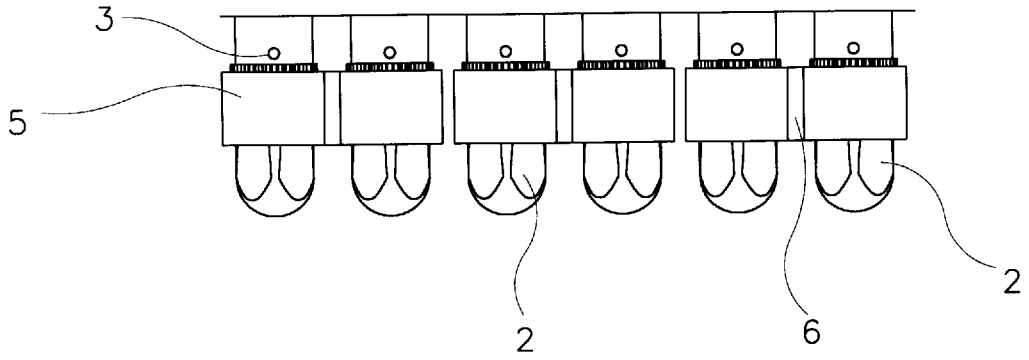

TUNING PIN APPARATUS HAVING IMPEDIMENT FUNCTION AGAINST THE REWINDING

BACKGROUND OF THE INVENTION

1. Field of the Invention

The present invention relates to a piano tuning pin apparatus for prevention, of loosening of the piano string, i.e., of rewinding of a piano tuning pin.

2. Description of the Prior Art

The conventional tuning pin for pianos, as shown in FIG. 1, consists of a screw thread part 1 embedded in the pin block, a inserting part 2 of a tuning hammer tip, and a tuning pin hole 3 inserting and winding the piano string therebetween.

However, the rewinding phenomenon of the tuning pin for pianos occurs with the lapse of time in the conventional tuning pin since impediment function against the rewinding of the screw thread is inferior to the offensive tension of said string due to pulling force occurred by means of tension of the piano string wound on the circumference surface thereof.

Furthermore, since such phenomenon occurs too early in some pianos, the tuning should be put again frequently. Accordingly, such phenomenon has become important problem in management of the piano. Another problem is that the piano is affected to change sound by variation of temperature and humidity or shock.

In order to solve these problems, impediment force for prevention of rewinding of the tuning pin needs, and the force can be achieved by construction of installation affecting additionally, for impediment of the winding force of the screw thread.

SUMMARY OF THE INVENTION

Therefore, an object of the invention is to solve the above-mentioned problems and to provide a tuning pin and a fixing portion of pin being set together with, thus achieving a improved tuning pin apparatus having the secondary impediment force against the rewinding by tension of the string besides the impediment force against the winding by the screw thread of the conventional tuning pin.

BRIEF DESCRIPTION OF THE DRAWINGS

These and other objects, features and advantages of the invention will become apparent from the following description of the embodiments with reference to the accompanying drawings, in which:

FIG. 1 is a plan view illustrating the conventional tuning pin for piano.

FIG. 2 is a plan view illustrating the tuning pin for piano in accordance with the present invention.

FIG. 3 is a perspective view illustrating the tuning pin for piano in accordance with the present invention.

FIG. 4 is an elevational view illustrating the tuning pin for piano in accordance with the present invention.

FIG. 5 is a perspective view illustrating a fixing portion of pin in accordance with the present invention.

FIG. 6 is a perspective view illustrating another fixing portion of pin in accordance with the present invention.

FIG. 7 is a plan view illustrating a condition that a tuning pin and a fixing portion of pin is assembled in accordance with the present invention.

DETAILED DESCRIPTION OF THE PREFERRED EMBODIMENT

FIG. 2 is a plan view illustrating a tuning pin in accordance with the present invention. It comprises a part 1 of the screw thread inserting in the pin block as in the conventional tuning pin, a part 2 that the tuning hammer tip as a head is inserted to and a tuning pin hole 3 being wound by inserting a piano string between them. Between said tuning hammer tip inserting part 2 and the tuning pin hole 3, a saw-toothed projected brake structure 4 is added to reinforce impediment function against the rewinding of the screw thread. The brake structure 4 is projected in saw tooth type in suitable height along with the circumference surface of the tuning pin to engage with the fixing portion of pin as described below.

In accordance with the present invention, the length of the tuning pin may be longer than that of the conventional tuning pin due to the added brake structure 4, but within the scope that it is not over the length of the tuning hammer tip inserting part 2, by suitable controlling of the part 2, it can be identical to that of the conventional tuning pin or can be suitable length.

FIGS. 3 and 4 are an illustrative view of the brake structure 4 of the tuning pin having impediment function against the rewinding, FIG. 3 is a perspective view thereof and FIG. 4 is an elevational view thereof. The ends of tooth part of brake structure 4 of the tuning pin having impediment function against the rewinding are sharp triangle, "∧" type tip, so that as shown in FIG. 7, it may be engaged to be fixed with a putting pipe 5 of the fixing portion of pin tightly enough to scratch inner surface thereof by the teeth when the brake structure 4 is inserted. Furthermore, if said brake structure 4 is inserted in the fixing portion of pin to exhibit the impediment function against the rewinding, another type including prominence and depression surface may be taken even if it is not a sharp triangle type.

FIG. 5 is a perspective view illustrating the fixing portion of pin in accordance with the present invention. It is an essential assembling apparatus to fix said tuning pin having impediment function against the rewinding, wherein two putting pipe 5 are fixed by a fixing die 6 and a hole 7 for heating modification is formed in their center. In the brake structure 4 of the two close tuning pin configured fixedly in the pin block, the fixing portion of pin is inserted to prevent the rewinding of each tuning pin in a state of preventing mutual rotation force by fixing force of the fixing portion of pin. The length of the fixing die 6 of the center for fixing right and left putting pipes 5 can be shrunk or elongated by means of heating of the central hole 7 for heating modification so that difference of the gap between two tuning pins may be controlled. Only shrinking and elongation of the fixing die 6 should be carried out before the tuning operation.

FIG. 6 is a perspective view illustrating another fixing portion of pin in accordance with the present invention. The fixing of pin is formed to be externally hexahedral shape, two putting pipes 5 are formed therein, and said putting pipes 5 is made in the form added semi-spherical shape to both lateral of a rectangular in order to engage with only the upper part and the lower part of the tuning pins with each other. According, when the upper and lower parts of tuning pin are engaged with each other, right and left thereof make a space, thus even though gaps between two tuning pins are slightly different from each other, the tuning pin can be applied to such the putting pipe. Thus, the method of differentiating the size of the fixing portion of pin due to variation of mutual gap on the tuning pin configured in the pin block can be simplified.

The present invention as described above has effects such as keeping a sound of a piano stable for a long term after the tuning, reducing a burden of expense according to the tuning, elongating life of the piano by protecting string equipment and increasing income of a piano tuner by activating depressed tuning environment, by prevent the rewinding phenomenon of the piano tuning pin according to the brake type fixing function acting each other by setting two tuning pins having the rewinding impediment function and, the fixing of pin consisting of two putting pipes together with.

Although the preferred embodiments of the invention have been disclosed for illustrative purpose, those skilled in the art will appreciate that various modifications, additions and substitutions are possible, without departing from the scope and spirit of the invention as disclosed in the accompanying claims.

What is claimed is:

1. A tuning apparatus comprising:

a tuning pin having a hole through which a string for tuning is to be strung;

a brake structure, said brake structure including a plurality of projections; and a fixing member including two putting pipes, each of said putting pipes having an inner surface; a fixing die connected and positioned between said two putting pipes, said fixing die including a hole in the center of said fixing die;

said tuning pin positioned within one of said putting pipes, the projections of the tuning pin engaging the inner surface of said one of said putting pipes impeding the tuning pin from rewinding.

2. The tuning apparatus of claim 1, said tuning pin further having a tuning hammer tip portion, wherein said brake structure is positioned between said tuning hammer tip portion and said hole, along the circumference of said tuning pin (when said tuning pin is viewed in the absence of said brake structure).

3. The tuning apparatus of claim 1, wherein said plurality of projections are triangular in shape and have a sharp tip.

4. The tuning apparatus of claim 1 wherein said fixing die is of a material which is suitable for modification of the gap between the two putting pipes by the application of heat to the hole in the center of said fixing die.

5. The tuning apparatus of claim 1 wherein said fixing die has an external hexahedral appearance, said putting pipes have a cross sectional appearance of an generally rectangular shape wherein two parallel sides of such rectangle have been replaced by semi-circular portions.

6. The tuning apparatus of claim 1, having said brake structure provided for each of said putting pipes in which a tuning pin is inserted.

7. The tuning apparatus of claim 1 which is adapted for a piano.

* * * * *